US005998690A

United States Patent [19]

Huang et al.

[11] Patent Number: 5,998,690

[45] Date of Patent: Dec. 7, 1999

[54] METHOD AND AGENTS FOR SOLIDIFICATION OF BORIC ACID AND/OR BORATES SOLUTIONS

[75] Inventors: Ching-Tsven Huang, Tao Yuan; Wen-Yi Yang, Ping Chen, both of Taiwan

[73] Assignee: Institute of Nuclear Energy Research, Tao Yuan, Taiwan

[21] Appl. No.: 08/994,929

[22] Filed: Dec. 19, 1997

[51] Int. Cl.[6] ..... G21F 9/00

[52] U.S. Cl. ..... 588/18; 588/3; 588/4; 588/9; 588/10; 588/12; 588/14; 588/15; 588/20

[58] Field of Search ..... 588/18, 3, 12, 588/14, 15, 9, 10, 20, 4

[56] References Cited

U.S. PATENT DOCUMENTS

| | | | |
|---|---|---|---|
| 4,210,619 | 7/1980 | Haley | 264/140 |
| 4,293,437 | 10/1981 | Taponier et al. | 252/301.1 W |
| 4,620,947 | 11/1986 | Carlson | 252/628 |
| 4,664,895 | 5/1987 | McDaniel | 423/277 |
| 4,800,042 | 1/1989 | Kurumada et al. | 252/628 |
| 5,096,624 | 3/1992 | Dorr et al. | 252/631 |
| 5,457,262 | 10/1995 | Huang et al. | 588/3 |
| 5,645,518 | 7/1997 | Wagh et al. | 588/252 |

*Primary Examiner*—Gary P. Straub
*Assistant Examiner*—Cam N. Nguyen
*Attorney, Agent, or Firm*—Burns, Doane, Swecker & Mathis, L.L.P.

[57] ABSTRACT

A unique method for solidification of solutions containing boric acid and/or borates is disclosed in this invention. The boron species in the solutions are polymerized to form polyborates, and the solutions are then solidified by mixing with solidification agents which are prepared completely from inorganic materials. Therefore, the solid form produced by this method has no aging problem. The boron species in the solution are not merely wastes to be encapsulated or embedded, they take part in the solidification reaction and share a major portion of total reactants. Thus, the total volume of solid forms produced in this invention is less than 1/10 of that produced in conventional cementation.

5 Claims, No Drawings

METHOD AND AGENTS FOR SOLIDIFICATION OF BORIC ACID AND/OR BORATES SOLUTIONS

BACKGROUND OF THE INVENTION

Solutions containing boric acid and/or borates are mainly produced during the running of pressurized water nuclear power stations. Because these solutions are radioactive, solidification treatment is necessary to change them into chemically and physically stable solid bodies in order to ensure nuclear power safety. For solidification treatment of these radioactive solutions, currently the frequently used mainly are the three methods of cement solidification, plastic solidification and bitumen solidification. Among the three methods, the cement solidification has the lowest solidification volume efficiency and as a result, although its operation is of the simplest and the cement solidified bodies are generally considered to possess a long-term safety, however, because the expenses for final disposal of solidified bodies of the radioactive wastes are counted by volume, the cement solidification process will gradually be replaced in a state when expenses for final disposal increase day by day. Both plastic solidification and bitumen solidification methods, on the other hand, use organic materials as the solidification agents. Although higher volume efficiency may be obtained by the two methods, the bitumen solidified bodies are burnable and have a low strength, there have also been instances of burning during the process of operation of bitumen solidification in foreign countries. Many countries in Europe have already banned use of bitumen solidification process and in many other countries except for those bitumen solidification systems that have been established earlier and still continue to be in use and for export to relatively under-developed countries, there is almost no newly built system to join in. The fact that the bitumen solidification process is being gradually eliminated is almost certain. As for the plastic solidification process, its use remains still a subject of dispute; even though newly built systems are continuously joining in, people, who hold a negative point of view, consider that the plastics is a material susceptible to ageing and since the history of use of plastics by mankind lasts merely about 50 years, it has not been possible to ascertain that the quality of plastic solidified bodies of the wastes remain stable for more than 300 years and would not change in substance and therefore, in many countries in Europe the plastic solidification process is no longer used. Generally speaking, the future of use of the plastic solidification process is mainly linked to whether the volume efficiency in solidification of the inorganic solidification agent can be raised to allow the ultimate handling expense to be lowered to an acceptable level. Otherwise, at the pressure of an ultimate handling cost, it may be expected that the plastic solidification process will continue to be adopted because of its excellent volume efficiency in solidification. Speaking from the current situation, research on enhancing the solidification volume efficiency of the inorganic solidification agent so that on the already available basis that the quality of inorganic solidified body is able to ensure a long-term stability, the reduction in volume of the solidified body enables the inorganic solidification method to also possess an advantage on volume efficiency, is a major direction on the current researches on solidification of low radioactive wastes.

The conventional cement solidification technique is also a kind of inorganic solidification method. When the method is used in solidification of borate wastes, generally boric acid is regulated to be alkaline by using sodium hydroxide and after boric acid is concentrated to a solution containing 21,000 ppm, lime and cement are added into it and the solution is sufficiently mixed and is then left motionless to allow it to be solidified. Because there is presence of an impediment effect on cement hydration hardening by boric acid, the content of borate wastes to be added into the cement slurry must not be excessive. Also, the content of boric acid in the borate wastes solidified body produced by the unimproved conventional solidification method is generally suitably not exceeding 5 wt %, if not, there will be problem as to the grade. Adding of lime is an improvement in relation to the conventional cement solidification method, which causes boric acid to form insoluble calcium borate crystals, avoids it from impeding hydration hardening action of the cement and thus helps in enhancing volume efficiency of the solidification. Such a conception has exactly been used in the so-called advanced cement solidification process developed by the Japanese firm, JGC Corporation, in which lime is first added into the liquid borate wastes and the solution at 40–60° C. is agitated for about 10 hr. to allow calcium borate to age and grow crystal. The solution is next filtered to obtain calcium borate crystals and finally, the calcium borate crystals are solidified with cement. By this process, it is said that 190 gal of liquid borate waste containing 21,000 ppm of boron can be solidified into a 55 gal barrel of solidified body. Compared with the conventional method, the volume efficiency of solidification shows a significant improvement, the operation is however tedious and the process is slightly complicated, while the equipment investment is also relatively high.

There still remain many methods for solidification of borate wastes performed with inorganic solidification agents, for instance, in U.S. Pat. No. 4,293,437 or French Patent FR-A-2,423,035, the borate solution is neutralized with alkalizer barite (baryta) having precipitation effect to form a concentrated suspension slurry containing barium borate precipitate. After further adding alkaline silicate acting as a suspension agent, finally cement and bitumen emulsion are again added into the suspension slurry to solidify the slurry. In this process, the boron content is increased by menas of production of a suspending liquid of barium borate precipitate and is finally solidified with cement and bitumen emulsion. It is said that the final solidified product of the process contains 233 g/l of the borate equivalents and the solidification volume efficiency has a higher solidification volume efficiency than the conventional cement solidification process.

In the process disclosed in U.S. Pat. No. 4,210,619, lime is added into the solution containing 11% boric acid and after boric acid is converted into insoluble calcium borate, cement is next added into the slurry obtained and mixed for solidification. In U.S. Pat. No. 4,800,042, lime is also added into the borate solution to convert boric acid into calcium borate and in a further step after calcium borate is filtered and separated it is solidified with cement to obtain a higher solidification volume efficiency than U.S. Pat. No. 4,210,619. The principle of this process is entirely the same as the advanced cement solidification process of the Japanese JGC.

Next, in the U.S. Pat. No. 4,620,947, magnesium oxide or magnesium hydroxide powder is first added into the borate solution to form magnesium borate, into which cement is then added and the mixture is agitated. Finally, before colloids are formed calcium oxide or calcium hydroxide is added for solidification. Following the conditions used in this patent, the concentration of boric acid in the liquid waste is about 10 wt % and weight of the lime, cement, magnesium hydroxide and calcium oxide added is several times the weight of the boric acid. Hence, the volume efficiency is very low and the compressive strength of the solidified bodies produced is also very low, the highest reaching only 22.5 kg/cm$^2$.

On the other hand, U.S. Pat. No. 4,664,895 discloses a process for solidification of the liquid borate waste by adding sodium metasilicate into a high concentrated borate solution. The boric acid concentration used in this process reaches as high as over 30 wt % of the liquid waste and the process is thus capable of obtaining a relatively high volume efficiency. The compressive strength of its solidified bodies however, lies between 500 psi to 700 psi (35 to 49 kg/cm$^2$) only, which is not high enough. Most importantly, the solidified product generated in this process is in the state of silicic acid and the water resistance property is not satisfactory.

U.S. Pat. No. 4,906,408 discloses a process for solidification of liquid borate waste and waste resin containing boric acid and according to the process the emphasis is on converting boric acid into calcium boroettringite and calcium monoboroaluminate to avoid any unsatisfactory reaction occurring between borate and cement or water that leads to expansion and cracking in the solidified bodies. According to this process, borate solution with a very low concentration is used and also into each unit volume of the borate solution, 1.75 time volume of the cement and silicon additive must be added. Hence, one can well imagine that the solidification volume efficiency according to this process is also very low.

In the above-mentioned prior art, a majority has adopted a technique of adding alkaline precipitating agent in converting borates into insoluble borides and then adding the solidifying agent, cement or bitumen for solidification, for example, the addition of alkaline barite to cause formation of a suspending liquid of barium borate precipitate in U.S. Pat. No. 4,293,437; addition of lime to cause conversion of borate into insoluble calcium borate in U.S. Pat. Nos. 4,210,619, 4,800,042 and 4,906,408; addition of magnesium oxide or magnesium hydroxide to form magnesium borate in U.S. Pat. No. 4,620,947. In these ways although there is improvement in solidification volume efficiency of the liquid borate waste, from the point of view of the present invention however, such solidification ways are unable to produce adequately the volume efficiency of solidification of boric acid, the reasons being that: (1) the alkaline precipitating agent added has basically increased the amount of the wastes and (2) borates are still regarded as wastes needed to be embedded, the weight percentage of borates within the solidified body is therefore subject to considerable limitation and the solidification volume efficiency can not be enhanced greatly.

SUMMARY OF THE INVENTION

Accordingly, the present invention has used a solidification mechanism completely different from the aforesaid process. In the present invention, borate itself no longer is only a waste to be embedded, it is a reactant in solidification. For boric acid to be able to take part effectively in the solidification, boric acid must be in the dissolving state, therefore, in view of the requirement for a quality on solidified bodies, boric acid in the dissolving state in the solution must maintain at above a certain degree of concentration, although there may be presence in the solution of insoluble borides. Accordingly, borates are preferably in the form of a salt of high solubility, in which the most suitable form is with sodium borate and other highly aqueous soluble borates, such as: potassium borate, lithium borate and ammonium borate can also be used. Therefore, in accordance with the present invention the target for solidification is not to be limited to the form of sodium borate. Also, in considering the use of additives every effort must be made not to cause precipitation in borides.

Boric acid is an intermediate aqueous soluble crystal and the liquid borate wastes produced in a nuclear power plant is, generally, regulated to be alkaline with sodium hydroxide. From the solution, sodium hydroxide and boric acid can be formed into various compounds of $xNa_2O.yB_2O_3.zH_2O$ series, for instance, $Na_2O.B_2O_3.4H_2O$ (sodium metaborate); $Na_2O.2B_2O_3.4H_2O$, $Na_2O.2B_2O_3.5H_2O$ and $Na_2O.2B_2O_3.1OH_2O$ (disodium tetraborate): $NaB_5O_8.5H_2O$ (sodium pentaborate); and $NA_2O.4B_2O_3.4H_2O$ (disodium octaborate). Because in the aqueous solution sodium borate changes much in chemical form, it is therefore, for convenience sake, to use generally the ppm concentration of boron in the solution for indication. In water, solubility of sodium borate varies greatly following changes in its chemical form and is also subject to the manipulation and control of pH value in the solution. In fact, the pH value is the main factor that has influence on the chemical form of sodium borate in the solution. Basically, speaking on sodium borate solution, the level of pH value represents a level of molar ratio of sodium: boron in the solution: the higher the molar ratio of sodium: boron, the higher will be the pH value. The results of experiment show that sodium borate has a high solubility when pH is within 7 to 9, and the content of boron in the dissolved state even can reach higher than a level of 135,000 ppm in the solution at a temperature of 40° C. when pH is within 7 to 8. Such superhigh level of solubility is obtained mainly as a result of borates forming a fairly stable temporary oversaturated solution. Concentration of the dissolved boron drops distinctly when molar ratio of sodium: boron is too high. It has also been discovered by the invention that in a high molar ratio of sodium: boron, concentration of the dissolved boron is effectively raised by regulating down the pH value with phosphoric acid.

In addition, by raising the temperature of the solution, it is also possible to increase markedly the concentration of the dissolved boron; however, the higher the temperature, the faster will be the rate of the hardening reaction, which will possibly lead to drawbacks, such as: insufficient time of mixing or temperature running too high. However, the temperature can be higher, if the solution, after mixing, is appropriately cooled, but when adding a hardener it is most preferable that the temperature of this solution is still below 100° C.

In the light of discovery of the invention, a borate solution of high concentration possesses a strong tendency to polymerization and with the raise in concentration the degree of polymerization also increases. The results of experiment show that in a sodium borate solution with molar ratio of sodium: boron of 0.3028, the density and the sodium borate concentration in the solution maintain from the beginning to the end in the relation of a linear direct proportion. The viscosity of the solution appears to be in the relation of a linear direct proportion only when the concentration is low, and when boron concentration reaches 80,000 ppm, the viscosity starts to increase quickly and distinctly and after reaching about 100,000 ppm the viscosity rises high even more quickly showing that the higher the concentration the stronger will be its tendency to polymerization. Experiments of the present invention prove that such a polymerization action has a very important effect on the quality of the hardened products of sodium borate. It has been discovered that when borate solution has a higher concentration, borates of a higher degree of polymerization will be formed and the strength of the solidified products will also be higher when a borate having a higher degree of polymerization is reacted with the solidification agent of the present invention. This constitutes a very useful excellent recycling rendering the process according to the invention to achieve at the same time a superhigh volume efficiency and a superhigh quality of solidified body, and is thus characteristic of the present invention. The process for solidifying wastes with a hardenable slurry prepared by mixing homogeneously the cementitious material, pozzolanic material and some additives with borate solution of a high concentration is disclosed in U.S. Pat. No. 5,457,262. In the present invention, more appropriate materials for solidification agents will be disclosed to further raise the quality of the solidified products of the process.

Based on experiments of the invention it is discovered that materials suitable to be the solidification agents for the aforesaid borates of high concentration include, in addition to the cementitious material, pozzolanic material disclosed in the patent and the indicated additives, all other materials capable of reacting with boric acid or borates to form insoluble or hardly soluble solids. All these can be used as solidification agents. Considering the quality that a solidified product must possess, it is preferable, however, that the materials for solidification agents be the materials that are capable of providing excellent compressive strength, water resistance and durability to the solidified bodies and of rendering structure of the solidified bodies to be fine and dense and having small and less pores, and are capable of obstructing the exit of the moisture. As a result of tests, among such materials oxides and hydroxides of metals of bivalence or above as well as salts of metallic silicate, phosphate and carbonate or composite salts thereof are found to be most appropriate. In selecting the materials, consideration must be on the structure stability of the solidified products formed by these materials with boric acid or borates and also on heating effect during the solidification. Ideal solidification products must possess the least expansibility or contractibility; whereas, the lower the heat of release the better will also be the solidification reaction.

The material of said solidification agents when used alone also has a solidification effect, however, speaking generally, it is appropriate relatively to use a compound solidification agent formed in composition from different materials so that the solidification products possess all the good qualities. For instance, reaction between magnesium oxide and boric acid produces solidified bodies having excellent water resistance. However, when excess magnesium oxide is used, contractibility in the solidified bodies gets relatively large and the bodies become fragile and easily breakable. This is disadvantageous to the stability in structure of the solidified bodies. The amount of magnesium oxide used, therefore, should not be too excessive, if not, there is likely that the solidified bodies develop a cracking phenomenon. Again, when, for example, silica is used as the material for solidification agents, although there is relatively less heat of release in the solidification reaction, the compressive strength of the solidified bodies is however low and the water resistance is also unsatisfactory. The amount of silica used, therefore, should not be excessive too. The materials used are not to be limited to those that are capable of producing solidification reaction with boric acid or salts thereof directly, the use of some materials is for enhancing the solidification of components other than boric acid in the liquid wastes or for compensating insufficiencies in the other solidification agent components in contribution to the quality. To take an example, when liquid wastes are in the sodium salt state of boric acid, because generally after solidification the sodium salt in the solidified bodies dissolves relatively easily leading possibly to an unsatisfactory water resistance in the solidified bodies, it is necessary, therefore, to take remedial measures to overcome the difficulty. A feasible way is to add an appropriate amount of silicic acid, and impel sodium in the state of sodium silicate to react with other metallic oxides, hydroxides or salts and form insoluble salts of sodium silicate to avoid sodium salt from dissolving out. Oxides, hydroxides or salts of barium, zirconium and titanium are also excellent solidification agent components and can be used as reactivity material for solidification agent or as filler to increase the stability in the structure.

Experiments according to the present invention prove that when the amount of solidification agent used is higher, the viscosity of the slurry mixed becomes higher and temperature of heating also becomes higher. Under the condition when mixing is excellent, the solidified bodies are also better in quality. However, if the amount of solidification agent used is excessive and trouble has been caused to the process of mixing such that a homogeneous mixing effect is not achieved, inhomogeneity will probably arise in the structure of the solidified bodies and thus leads to undesirableness in quality. Generally speaking, for each kg of solution it is suitable to use a solidification agent of below 0.7 kg and 0.3 to 0.5 kg is most preferred.

In the following, the solidification process and preparation of the solidification agents according to the present invention will be described by way of examples, which are merely embodiments of portions of the invention and shall not represent the entire scope of utilization and it is thus not intended that the scope of the present invention be limited.

EXAMPLE 1

288 parts by weight of 95% sodium hydroxide and 1,400 parts by weight of 99% boric acid were obtained and were each divided into two equal parts. Each of the two equal parts was again divided twice and the parts were added in order gradually into 600 parts by weight of deionized water under agitation. The sequence of addition is as follows: sodium hydroxide—boric acid—sodium hydroxide—boric acid. To wait for sodium hydroxide was completely dissolved, the mixture solution was heated slightly to allow boric acid to dissolve completely. Dissolved boron concentration of the solution thus obtained was 105,943 ppm and the molar ratio of sodium/boron was 0.3. After boric acid was dissolved, the solution was continuously stirred and was cooled to 40° C., at which temperature the solution was kept for ready use. Before addition of the solidification agent, the solution must be weighed again in order to know the weight lost by evaporation of moisture in the abovementioned preparation process and was supplemented with water of the same temparature.

16 parts of Portland type II cement produced by Taiwan Cement Company, 13 parts of tribasic magnesium phosphate powder and 0.4 part of stranded carbon fiber were mixed, homogenized and then pulverized to prepare the solidification agent powder. Thereafter, this solidification agent powder was gradually added into a ready-for-use boric acid solution and was at the same time vigorously agitated to allow the solidification agent powder to mix with the solution to form a homogeneous slurry. The weight ratio of solidification agent to waste fluid is 0.4. Agitation was stopped ten minutes after the solidification agent was completely added, the slurry was immediately poured into a cylindrical polyethylene plastic model having an inner diameter of 5 cm and a height of 11 cm and then was left at the room temperature. Demolding took place 30 days after the solidification and 5 samples were obtained and cut into 10 cm long cylindrical specimens, the specimens were again tested for compressive strength under ASTM C39 procedure in accordance with the quality specification of the U.S. Nuclear Regulatory Commission. From the result of the test, the average compressive strength of the 5 samples is 189 $kg/cm^2$.

EXAMPLE 2

Borate solution and solidification agent were prepared in the same steps as in Example 1. In the solution, the concentration of the dissolved boron and the molar ratio of sodium: boron were also the same as in Example 1; the component of solidification agent was however changed to 4 parts of type 2A mud solidification agent (for composition, please refer to U.S. Pat. No. 5,457,262) with 1 part of magnesium oxide, 1 part of tribasic magnesium phosphate and 0.09 part of stranded carbon fiber. The weight ratio of solidification to liquid waste used was 0.3328. Demolding took place 7 days after the solidification and test was performed similarly with 5 samples. From the result, the compressive strength is 130 $kg/cm^2$.

EXAMPLE 3

Borate solution and solidification agent were prepared in the same steps as in Example 1. In the solution, the concentration of the dissolved boron and the molar ratio of sodium:boron were the same as in Example 1; the component of solidification agent was however changed to 15 parts of Portland cement with 3 parts of fume silica, 7 parts of silicon phosphate and 0.4 part of carbon fiber. The weight ratio of solidification agent to liquid waste used in the solidification was lowered to 0.289. From the result, it was obtained that the compressive strength after presservation for 8 months of the solidified body is 105 $kg/cm^2$ and the water resistant compressive strength is 93 $kg/cm^2$.

EXAMPLE 4

Borate solution was prepared in the same steps as in Example 1 and in the solution the concentration of boron was made to be 120,000 ppm and the molar ratio of sodium:boron was 0.32. Thereafter, the fine powder of $BaSiO_3$ was used as the solidification agent and solidification was performed with a ratio of each part of borate solution with 0.37 part of solidification agent. Demolding took place 7 days after solidification and test was performed similarly with 5 samples. From the result, the compressive strength is 61 $kg/cm^2$.

EXAMPLE 5

Borate solution was prepared in the same steps as in Example 1, however, the molar ratio of sodium:boron was raised and pH of the solution was adjusted low with 85% phosphoric acid. The prepared simulative liquid borate waste was measured to contain boron of 77,728 ppm, the molar ratio of sodium:boron of 0.7 and phosphoric acid ($H_3PO_4$) of 25,909 ppm. The preparation process of the solidification agent was also the same as in Example 1, its composition being 13 parts of type IIA mud solidification agent of Taiwan cement Company with 6 parts of magnesium oxide and 0.3 part of stranded carbon fiber. In solidification, the weight ratio of solidification agent to liquid waste was 0.2383. Demolding took place 30 days after solidification and test was performed similarly with 5 samples. From the result, the compressive strength is 193 $kg/cm^2$ and the water resistant compressive strength is 172 $kg/cm^2$.

We claim:

1. A process for the solidification of an alkaline aqueous solution containing sodium borate comprising the following steps:

(i) adjusting the pH of said alkaline solution containing sodium borate such that the pH ranges from 7 to 10 by the addition of phosphoric acid or silicic acid (ii) concentrating the resultant aqueous solution to produce a concentrated solution wherein the water content is less than 30% by weight and are maintained in soluble form thereby promoting the formation of polyborates having a high degree of polymerization;

(iii) adding to the resultant concentrated aqueous solution a solidifying agent which comprises at least one mixed powder which contains at least one compound selected from the group consisting of a metal oxide, metal hydroxide and metal salt; and (iv) mixing said at least one mixed powder to homogeneity to produce a hardenable slurry.

2. The process of claim 1, wherein said metal oxide, hydroxide or salt contains a metal selected from the group consisting of calcium, silicon, barium, magnesium, aluminum, iron, titanium, and zirconium.

3. The process of claim 1, wherein said mixed powder contains a material selected from the group consisting of a Portland cement, blast furnace slag, and fly ash material.

4. The process of claim 3, wherein said solidifying agent comprises silicophosphoric acid.

5. The process of claim 1, wherein the mixed powder comprises barium silicate.

* * * * *